US006516159B1

(12) United States Patent
Sakurai

(10) Patent No.: US 6,516,159 B1
(45) Date of Patent: Feb. 4, 2003

(54) DEVELOPER AMOUNT INDICATING METHOD AND ELECTROPHOTOGRAPHIC IMAGE FORMING APPARATUS

(75) Inventor: Kazushige Sakurai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/695,034

(22) Filed: Oct. 25, 2000

(30) Foreign Application Priority Data

Oct. 27, 1999 (JP) ..... 11-306078
Oct. 6, 2000 (JP) ..... 2000-308479

(51) Int. Cl.[7] ..... G03G 15/08

(52) U.S. Cl. ..... 399/27; 347/7; 347/19; 399/24; 399/29

(58) Field of Search ..... 399/12, 24, 25, 399/27, 29, 30, 81; 430/120; 347/7, 19

(56) References Cited

U.S. PATENT DOCUMENTS 5,475,471 12/1995 Kisu et al.
5,534,344 7/1996 Kisu et al. ..... 428/323
5,541,711 7/1996 Kisu et al.
5,765,077 6/1998 Sakurai et al. ..... 399/176
5,802,420 * 9/1998 Garr et al. ..... 399/27

* cited by examiner

*Primary Examiner*—Hoang Ngo
(74) *Attorney, Agent, or Firm*—Fitzpatrick, Cella, Harper & Scinto

(57) ABSTRACT

A developer amount indicating method of successively indicating a developer amount in a developer containing portion mounted on an electrophotographic image forming apparatus main body, the method including the steps of successively indicating the developer amount based on a detection result of a first detector for successively detecting the developer amount in the developer containing portion, and subsequently and successively indicating the developer amount based on the detection result of a second detector for successively detecting the developer amount in the developer containing portion.

18 Claims, 17 Drawing Sheets

DEVELOPER AMOUNT INDICATING METHOD AND ELECTROPHOTOGRAPHIC IMAGE FORMING APPARATUS

BACKGROUND OF THE INVENTION

Field of the Invention

The present invention relates to a developer amount indicating method and an electrophotographic image forming apparatus.

Here, the electrophotographic image forming apparatus uses an electrophotographic-image-forming process to form an image on a recording medium. Moreover, examples of the apparatus include an electrophotographic copying machine, an electrophotographic printer (e.g., LED printer, laser beam printer, and the like), an electrophotographic facsimile machine, an electrophotographic word processor, and the like.

Furthermore, a process cartridge is constituted by integrally containing at least one of charging means, developing means and cleaning means as process means, and an electrophotographic photosensitive member in a cartridge, and the cartridge is detachably mountable to an electrophotographic image forming apparatus main body. Moreover, the process cartridge may be constituted by integrally containing at least the developing means as the process means and the electrophotographic photosensitive member in the cartridge, and the cartridge is detachably mountable to the electrophotographic image forming apparatus main body.

Related Background Art

In a conventional electrophotographic image forming apparatus, employed is a process-cartridge system in which an electrophotographic photosensitive member and process means acting on the electrophotographic photosensitive member are integrally contained in a cartridge, and the cartridge is detachably mountable on an electrophotographic image forming apparatus main body. According to the process cartridge system, since maintenance of the apparatus can be performed not by a serviceman but by a user, operability can remarkably be enhanced. Therefore, the process cartridge system is broadly used in the electrophotographic image forming apparatus.

The image forming apparatus of the process cartridge system is generally provided with a function of detecting that a remaining amount of a developer in a developer container disposed in a process cartridge is a predetermined value or less as a standard for the user to change the process cartridge, and notifying the user.

Moreover, in order to further enhance the convenience of the user, for example, as shown in FIG. 17, an apparatus provided with means for successively detecting the developer remaining amount, and provided with a function of successively notifying the user of the developer remaining amount by a gauge indicating the developer amount is put to practical use.

In a developer amount indicator 60 shown in FIG. 17, a pointer 61 moves in accordance with the developer remaining amount to point at a portion of a gauge 62 provided with graduations 63 of "Full" to "Empty" and notifies the user of the developer remaining amount.

The present invention is a further development of the aforementioned conventional art.

SUMMARY OF THE INVENTION

An object of the present invention is to provide a developer amount indicating method in which a developer amount can successively be indicated and an electrophotographic image forming apparatus.

Another object of the present invention is to provide a developer amount indicating method in which the developer amount can be indicated with good precision and an electrophotographic image forming apparatus.

Still another object of the present invention is to provide a developer amount indicating method which is comprehensible for a user and an electrophotographic image forming apparatus.

A further object of the present invention is to provide a developer amount indicating method in which two or more developer amount detecting means are used to detect a remaining amount of a developer in a developer containing portion, and an indication of the remaining developer amount can be performed in accordance with properties of the developer amount detecting means to notify the user and the user can be notified of a correct developer amount, and an electrophotographic image forming apparatus.

Still further object of the present invention is to provide a developer amount indicating method in which the user can correctly be notified of the developer remaining amount in more detail when the developer amount is reduced and an electrophotographic image forming apparatus.

Another object of the present invention is to provide a developer amount indicating method of successively indicating a developer amount based on a detection result of first detecting means for successively detecting the developer amount in a developer containing portion, and subsequently successively indicating the developer amount based on a detection result of second detecting means for successively detecting the developer amount in the developer containing portion.

Still another object of the present invention is to provide a developer amount indicating method of successively indicating a developer amount based on a detection result of first detecting means for successively detecting the developer amount in a developer containing portion, and subsequently successively indicating the developer amount based on the detection result of the first detecting means and a detection result of second detecting means for successively detecting the developer amount in the developer containing portion.

A further object of the present invention is to provide an electrophotographic image forming apparatus comprising:

an electrophotographic photosensitive member;

developing means for developing an electrostatic latent image formed on the electrophotographic photosensitive member;

a developer containing portion for containing a developer for use in developing the electrostatic latent image by the developing means;

first detecting means for successively detecting a developer amount in the developer containing portion;

second detecting means for successively detecting the developer amount in the developer containing portion; and indicating means for successively indicating the developer amount based on a detection result of the first detecting means, and subsequently successively indicating the developer amount based on a detection result of the second detecting means.

A still further object of the present invention is to provide an electrophotographic image forming apparatus comprising:

an electrophotographic photosensitive member;

developing means for developing an electrostatic latent image formed on the electrophotographic photosensitive member;

a developer containing portion for containing a developer for use in developing the electrostatic latent image by the developing means;

first detecting means for successively detecting a developer amount in the developer containing portion;

second detecting means for successively detecting the developer amount in the developer containing portion; and indicating means for successively indicating the developer amount based on a detection result of the first detecting means, and subsequently successively indicating the developer amount based on the detection result of the first detecting means and a detection result of the second detecting means.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

A developer amount indicating method and an electrophotographic image forming apparatus according to the present invention will be described hereinafter in more detail with reference to the accompanying drawings.

Embodiment 1

Figure 1:
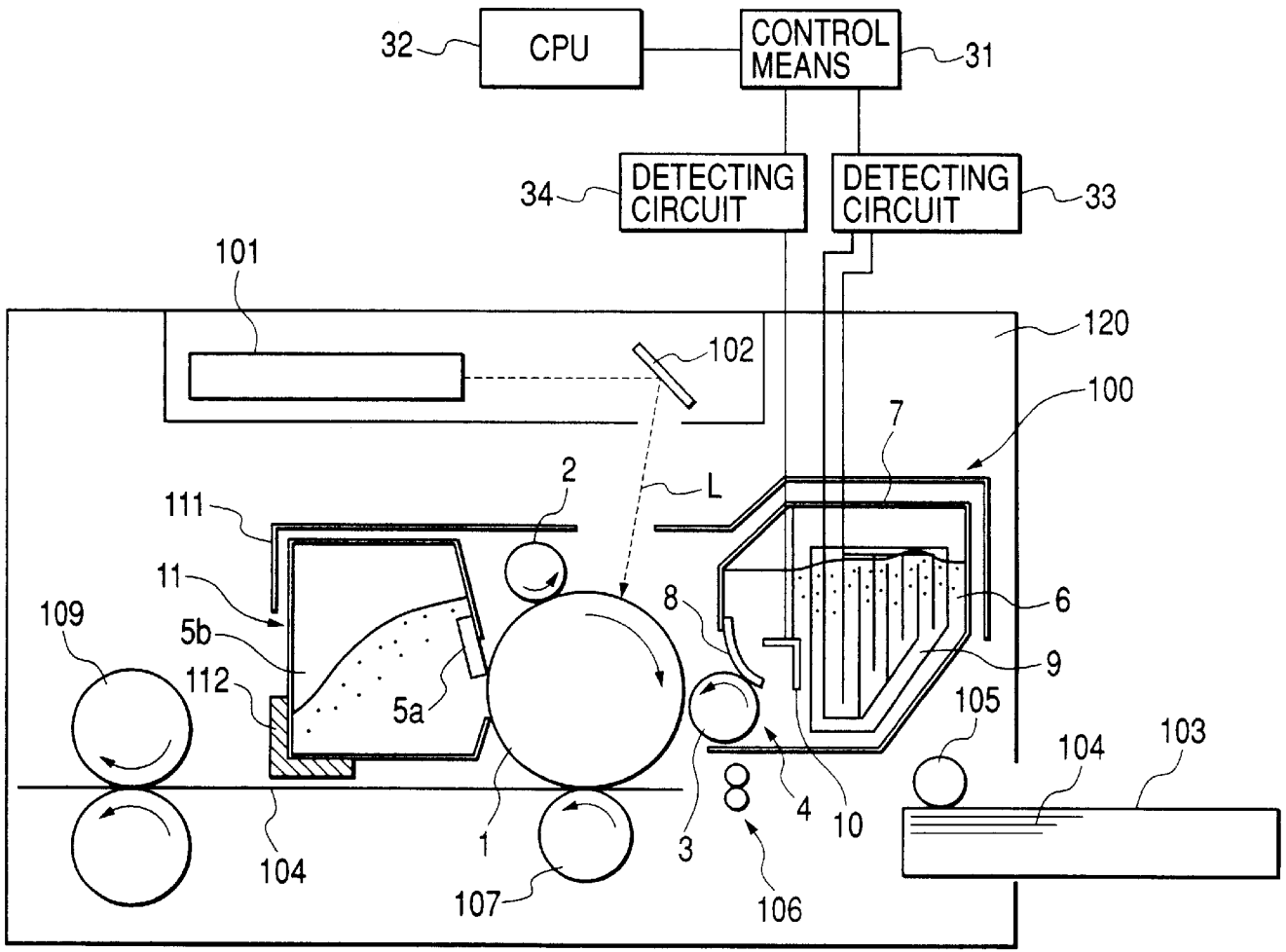
FIG. 1 is a schematic view showing one embodiment of an electrophotographic image forming apparatus according to the present invention.

First, one embodiment of the electrophotographic image forming apparatus according to the present invention will be described with reference to FIG. 1. In the present embodiment, the electrophotographic image forming apparatus (an image forming apparatus) is embodied as a laser beam printer on which a process cartridge is detachably mountable, and an image is formed on recording media such as a recording sheet, an OHP sheet, and cloth by an electrophotographic image forming process. FIG. 1 schematically shows a section while a process cartridge 100 described later in detail is mounted on an image forming apparatus main body 120.

As shown in FIG. 1, the image forming apparatus of the present embodiment is provided with a cylindrical electrophotographic photosensitive member (a photosensitive drum) 1 rotatable in a direction indicated by an arrow in FIG. 1 as an image bearing member, and an electrostatic latent image is formed on the surface of the photosensitive drum 1 by electrostatic latent image forming means. Specifically, the surface of the photosensitive drum 1 is uniformly charged beforehand by a charging roller 2 as charging means. Subsequently, a scanner unit 101 as exposure means provided with a laser, and a polygon mirror correction lens outputs a laser beam L modulated in response to an image signal, the laser beam L is reflected by a mirror 102 and the photosensitive drum 1 is irradiated. In this manner, the electrostatic latent image is formed on the photosensitive drum 1 in accordance with irradiation of the laser beam L. The electrostatic latent image is then developed by a developing device 7, and formed into a visible image, that is, a toner image.

Specifically, the developing device 7 is provided with, as developing means 4, a developing roller 3 which is a developer bearing member and a developer layer thickness regulating blade 8 for regulating a layer thickness of a developer borne on the developing roller 3. Moreover, a developer container 6 as a developer containing portion is disposed adjacent to and connected to the developing means 4. The developer stored in the developer container 6 is charged and borne by the peripheral surface of the developing roller 3 with rotation of the developing roller 3 in a direction indicated by an arrow in FIG. 1. Additionally, the developer layer thickness regulating blade 8 regulates the layer thickness of the developer on the developing roller 3, and a developable developer layer is formed. Moreover, the electrostatic latent image on the photosensitive drum 1 is visualized as a so-called toner image by transferring the developer from the developer layer on the developing roller 3. Usually, a developing bias voltage constituted by superimposing a DC voltage to an AC voltage is applied to the developing roller 3.

On the other hand, a recording medium 104 contained in a recording medium containing cassette 103 is fed out by a recording medium feed roller 105 in synchronism with formation of the electrostatic latent image on the photosensitive drum 1. Furthermore, the recording medium 104 is conveyed to roller-shaped transfer means, that is, an opposed portion (transfer portion) of a transfer roller 107 and the photosensitive drum 1 in synchronism with a leading end of the toner image formed on the photosensitive drum 1 by a registration roller pair 106. The transfer roller 107 transfers the toner image onto the recording medium 104.

The recording medium 104 with the toner image transferred thereto is conveyed to a fixing device 109, in which the toner image is fixed on the recording medium 104 by heat and pressure and formed into a permanent image. Thereafter, the recording medium 104 with the permanent image formed thereon is discharged out of the image forming apparatus. Moreover the developer remaining on the photosensitive drum 1 is removed by cleaning means 5*a*, and collected to a waste developer container 5*b*. In this manner, the photosensitive drum 1 is repeatedly used for image formation.

As shown in FIG. 1, in the present embodiment, the photosensitive drum 1, charging means (charging roller) 2 as process means acting on the photosensitive drum 1, a developing device 7 provided with the developing roller 3, a developer layer thickness regulating blade 8 and a developer container 6, and a cleaning device 11 provided with the cleaning means 5*a* and a waste developer container 5*b* are integrally connected by a frame 111 and made into a cartridge, to constitute the process cartridge 100.

The process cartridge 100 is detachably mounted on the image forming apparatus main body 120 via mounting means 112 provided in the image forming apparatus main body 120. The process cartridge 100 can be changed by the user itself when the developer stored in the developer container 6 is depleted, or when the photosensitive drum 1 expires.

According to the present invention, the image forming apparatus includes at least two developer amount detecting means in order to successively detect the developer amount. Specifically, in the present embodiment, the developer amount detecting means for successively detecting the developer amount in the developer containing portion includes first developer amount detecting means 9 disposed in the developer container 6, and second developer amount detecting means 10 disposed in the vicinity of the developing roller 3.

Moreover, the first and second developer amount detecting means 9, 10 are electrically connected to first and second developer amount detecting circuits 33, 34 disposed in the image forming apparatus main body 120 while the process cartridge 100 is mounted on the image forming apparatus main body 120. The first and second developer amount detecting circuits 33, 34 input developer amount information as voltage signals outputted from the first and second developer amount detecting means 9, 10, subject this signal to amplification processing or another predetermined signal processing operation and convert the signal to a developer-amount detecting signal, which is an electric signal. Subsequently, this signal is sent to control means 31 disposed in the image forming apparatus main body 120. Moreover, the control means 31 is connected to a central processing unit (CPU) 32 similarly disposed in the image forming apparatus main body 120.

The CPU 32 calculates the developer amount based on the signal from the control means 31. Moreover, as described later in detail, a signal for indicating the developer amount based on the detection results of the first and second developer amount detecting means 9, 10 is outputted.

In the present embodiment, the control means 31, a CPU 32, and first and second developer amount detecting circuits 33, 34 constitute a controller for indicating the developer amount based on the detection results of the first and second developer amount detecting means 9, 10.

In the present embodiment, the developer amount contained in the developer container 6 of the process cartridge 100 was set to 500 g when the cartridge was new. Moreover, the number of printable sheets with a standard print density in the developer amount was 10000 sheets.

Figure 2:
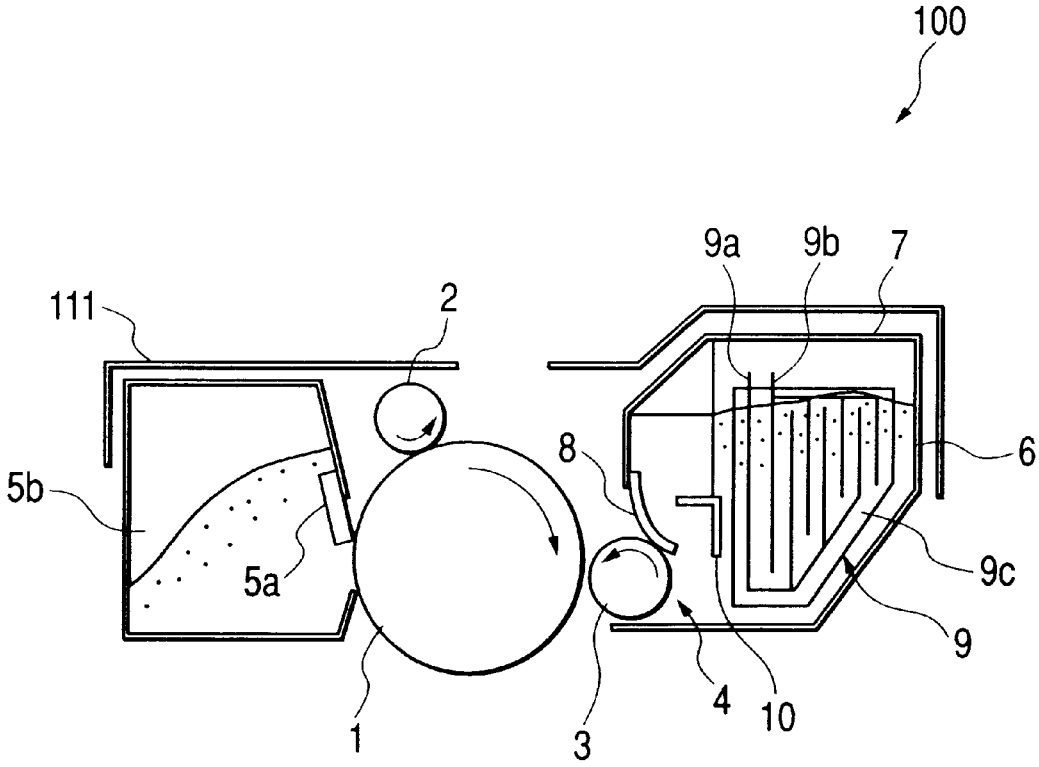
FIG. 2 is a schematic view showing one embodiment of a process cartridge detachably mountable on the electrophotographic image forming apparatus according to the present invention.

The developer amount detecting means of the present embodiment will further be described with reference to FIGS. 2, 3A and 3B. FIG. 2 schematically shows a side section of the process cartridge 100 of the present embodiment.

As shown in FIG. 2, in the present embodiment, the first developer amount detecting means 9 is constituted by disposing an electrode on a plane in a pectinate shape. Specifically, the first developer amount detecting means is constituted as the measurement electrode member 9 in which at least one pair of an input-side electrode 9*a* and an output-side electrode 9*b* are provided with portions juxtaposed on a substrate 9*c* with a predetermined interval. The measurement electrode member 9 is disposed substantially perpendicularly to a direction in which a developer height changes with a decrease of the developer in the developer container 6. A capacitance between the electrodes 9*a* and 9*b* of the measurement electrode member 9, that is, between conductors changes in accordance with a developer area that covers the plane.

Specifically, when much developer exists in the developer container 6, the developer area for covering the plane with an electrode pattern formed thereon is enlarged. Thereby, since the developer is larger in permittivity than air, the detected capacitance between the electrodes 9*a* and 9*b* is enlarged. Moreover, when little developer exists in the developer container 6, the developer area for covering the plane with the electrode pattern formed thereon is reduced. Thereby, the detected capacitance between the electrodes 9*a* and 9*b* is reduced. Therefore, by measuring the capacitance between the electrodes 9*a* and 9*b*, the remaining amount of the developer in the developer container 6 can successively be detected.

In the present embodiment, by applying an alternating voltage of a peak-to-peak voltage 20 Vp-p between the electrodes 9*a* and 9*b* via the input-side electrode 9*a*, the capacitance of the pectinate electrode pattern is detected via the output-side electrode 9*b*.

Moreover, in the present embodiment, as the second developer amount detecting means, the electrode plate 10 is disposed along and in the vicinity of a longitudinal direction of the developing roller 3. The capacitance between the developing roller 3 and the electrode plate 10, that is, between the conductors, changes in accordance with the amount of the developer present therebetween.

Specifically, since the permittivity of the developer is larger than that of air, with a large amount of developer present between the developing roller 3 and the electrode plate 10, the capacitance between the developing roller 3 and the electrode plate 10 is enlarged. Moreover, when the developer amount decreases, a small capacitance is detected between the developing roller 3 and the electrode plate 10. Therefore, the developer amount in the vicinity of the developing roller 3 can successively be detected by measuring the capacitance between the developing roller 3 and the electrode plate 10.

The present embodiment is constituted in such a manner that the capacitance between the developing roller 3 and the electrode plate 10 is measured by detecting a developing bias alternating (AC) component applied to the developing roller 3 by the electrode plate 10.

Figure 3A:
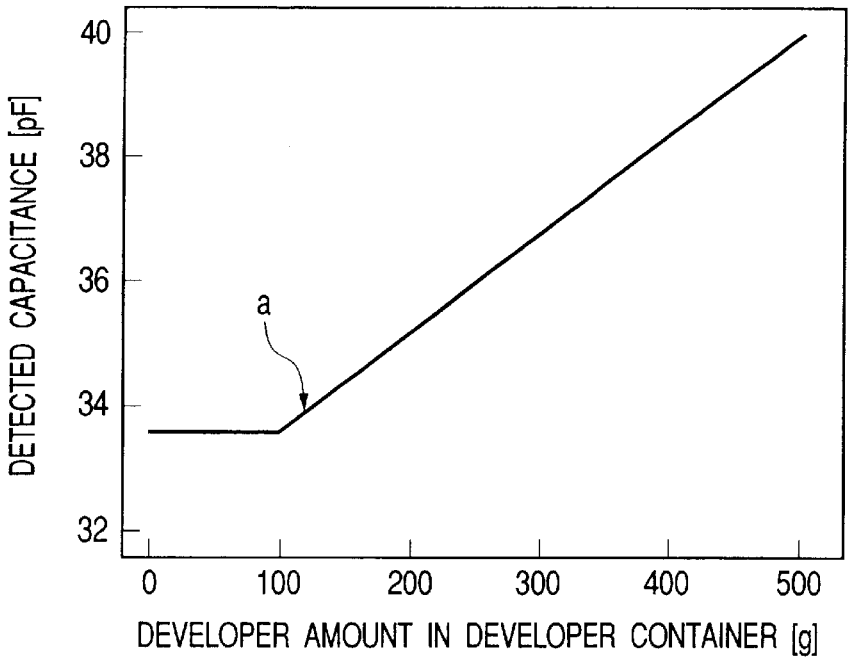
FIGS. 3A and 3B are graphs of output characteristics of developer amount detecting means for describing the output characteristics of a pectinate measurement electrode member and an electrode plate disposed in the vicinity of a developing roller, respectively.
Figure 3B:
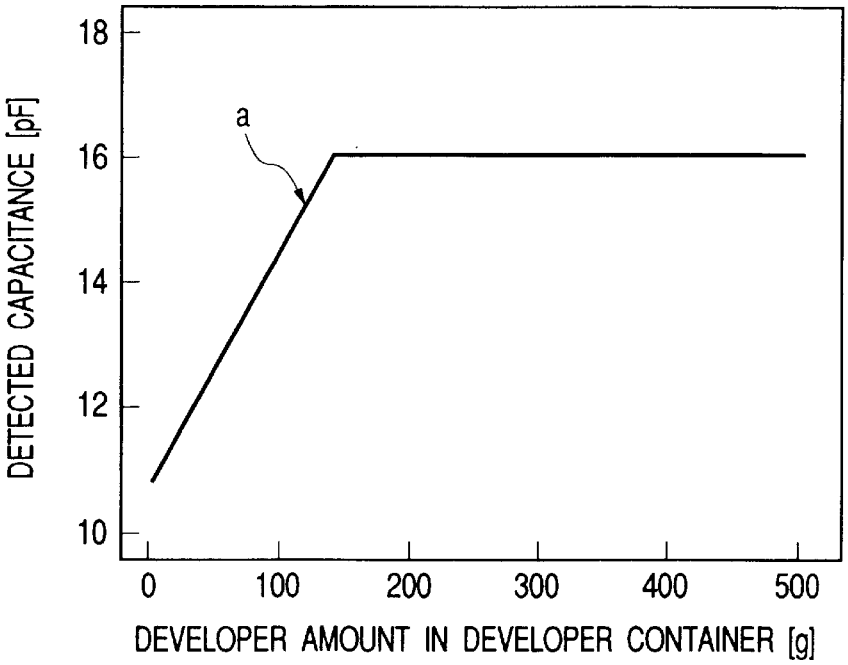

FIGS. 3A and 3B show output characteristics of the first developer amount detecting means (measurement electrode member) 9 and second developer amount detecting means (electrode plate) 10.

FIG. 3A shows the output characteristics of the measurement electrode member 9. Here, the abscissa indicates the remaining amount of the developer in the developer container 6, and the ordinate indicates the capacitance (pF) between the electrodes 9*a* and 9*b*. As understood from FIG. 3A, the capacitance between the electrodes 9*a* and 9*b* decreases in accordance with the developer remaining amount from a time when the container is full of the developer, that is, from a time when the process cartridge 100 is new (with 500 g of developer) to a time when the developer remaining amount reaches about 100 g.

No change in capacitance is seen when the developer remaining amount is 100 g or less. This is because almost all of the developer having decreased to this extent exists on the side of the developing roller 3, and the developer for covering the surface of the measurement electrode member 9 disposed in the developer container 6 therefore fails to exist.

FIG. 3B shows the output characteristics from the electrode plate 10. Here, the abscissa indicates the remaining amount of the developer in the developer container 6, and the ordinate indicates the capacitance between the developing roller 3 and the electrode plate 10. As understood from FIG. 3B, the capacitance detected by the electrode plate 10 substantially fails to change from a time when the container is full of the developer, that is, from a time when the process cartridge 100 is new (with 500 g of developer) to a time when the developer remaining amount reaches about 150 g. When the developer remaining amount is about 150 g or less, the capacitance rapidly decreases in accordance with the developer remaining amount. The reasons why no change in capacitance is seen until the developer amount reaches about 150 g are that a sufficient amount of developer remains, much developer also exists in the developer container 6, and the gap between the developing roller 3 and the electrode plate 10 is constantly filled with the developer.

Here, in FIGS. 3A and 3B, when the respective capacitance-change ranges are compared with each other, the measurement electrode member 9 (FIG. 3A) has a capacitance-change amount of about 6 Pf with respect to a developer-change amount of 400 g, and the electrode plate 10 (FIG. 3B) has a capacitance-change amount of about 5 Pf with respect to a developer-change amount of 150 g.

As a result, it would be understood that for properties of the measurement electrode member 9, a detectable developer amount range is broad, but the member is inferior to the electrode plate 10 in detection precision, and detection becomes impossible with a developer amount decrease. On the other hand, the electrode plate 10 (FIG. 3B) is narrow in its detection span, but superior to the measurement electrode member 9 in detection precision, and detection is possible until the developer runs out.

Therefore, from a time when the developer container 6 is full of the developer, that is, from a time when the process cartridge 100 is new, to a time shown by an arrow a in FIGS. 3A and 3B that is, to a time when the developer residual amount becomes larger than a developer residual amount unable to be detected by the measurement electrode member 9 by a predetermined amount, the measurement electrode member 9 is used to detect the developer residual amount. Moreover, the electrode plate 10 is preferably used to perform the residual amount detection from the time shown by the arrow a until the developer runs out.

Figure 4:
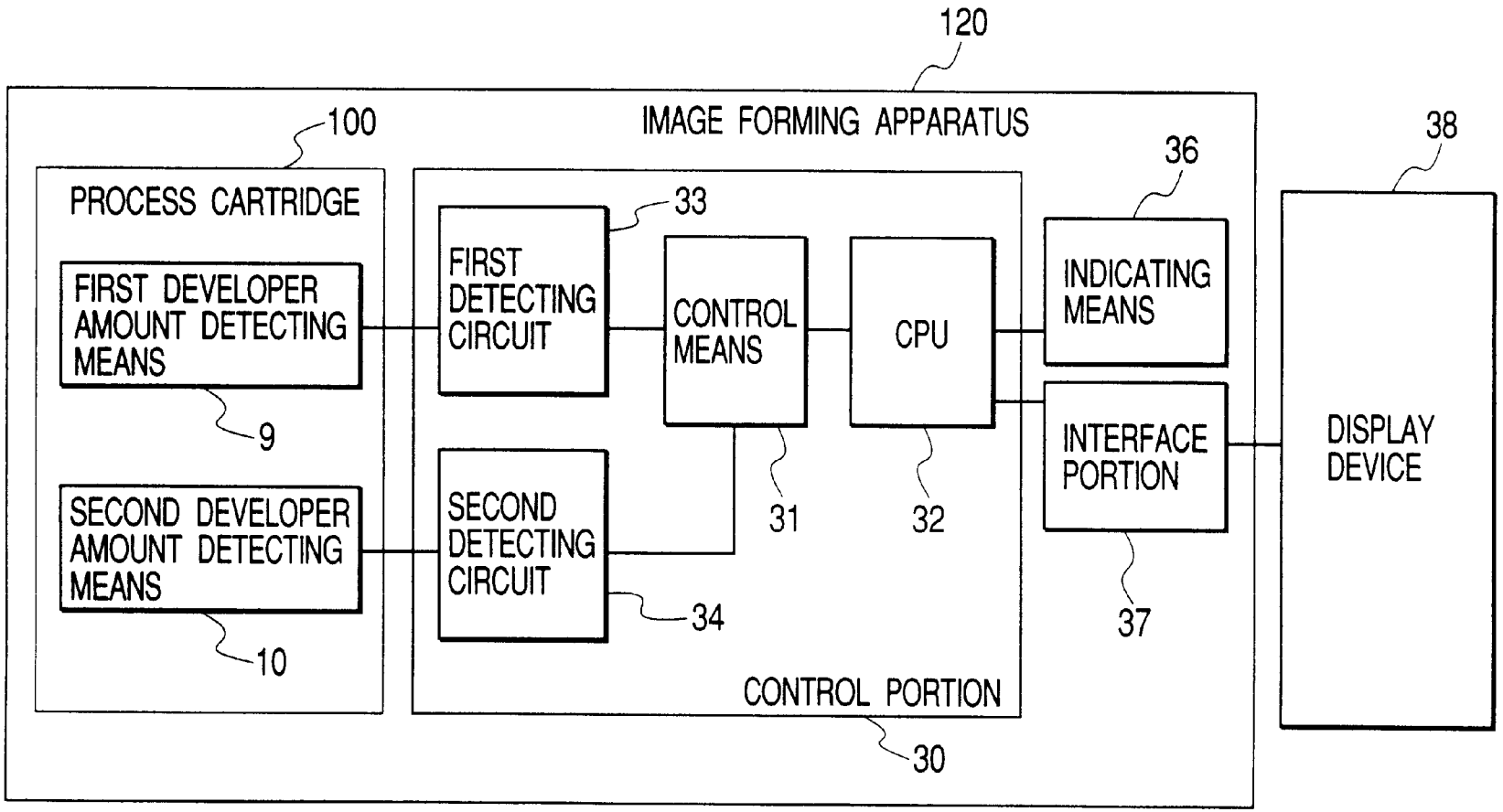
FIG. 4 is a block diagram of one embodiment of the electrophotographic image forming apparatus according to the present invention.

A developer-amount-indication-control system in the present embodiment will further be described also with reference to FIG. 4. In the present embodiment, the signals corresponding to the developer amounts detected by the first developer amount detecting means (measurement electrode member) 9 and second developer amount detecting means (electrode plate) 10 disposed in the process cartridge 100 are converted to electric signals by the first, second developer amount detecting circuits 33, 34, and sent to the control means 31.

The control means 31 calculates the developer- amount from the respective signals and sends the amount to the CPU 32. The CPU 32 sends a signal indicating the developer amount to indicating means 36 constituted, for example, of a liquid crystal display disposed in the image forming apparatus main body 120.

Moreover, as shown in FIG. 4, the signal of the CPU 32 is sent to an external display device 38 of the image forming apparatus main body 120 via an interface portion 37, so that the developer amount may be indicated on the external display device 38. Concrete examples of the external display device 38 include a screen (a display) of a host computer connected to the image forming apparatus, and the like in the image forming apparatus connected to a personal computer network.

By indicating the developer amount on the external display device 38 connected to the image forming apparatus main body 120 in such a manner that communication is possible, for example, the developer amount can be known during operation of the host computer, and convenience can remarkably be enhanced.

A developer amount indicating method of the present embodiment will next be described with reference to FIGS. 5A and 5B.

In the present embodiment, according to the present invention, first the developer amount is successively indicated based on the detection result of the first developer amount detecting means, and then the developer amount is successively indicated based on the detection result of the second developer amount detecting means. In this case, it is recognized by respective detectable areas that detection by the first and second developer amount detecting means is switched, and then a developer amount indicator is switched.

Figure 5A:
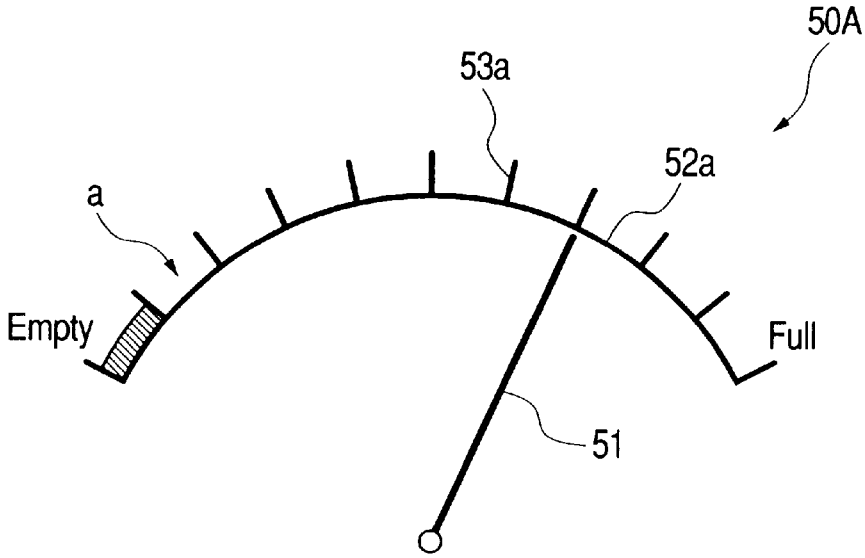
FIGS. 5A and 5B are diagrams showing one embodiment of a developer amount indicating method according to the present invention.

Specifically, according to the present embodiment, first, in early stages of use of the process cartridge, a first developer amount indicator 50A shown in FIG. 5A is displayed. In the first developer amount indicator 50A shown in FIG. 5A, a gauge 52*a* is divided by graduations 53*a* for dividing a span of "Full" to "Empty" into ten equal portions, and one graduation corresponds to 50 g of developer. Moreover, a pointer 51 moves to the side of "Empty" of the graduations 53*a* with the decrease of the developer in the developer container 6, that is, as a top surface of the developer in the developer container 6 lowers, and the user can know the developer residual amount by a portion at which the pointer 51 points.

Here, in the developer amount indicator 50A with a large residual amount of developer, the pointer 51 moves in accordance with the detection result of the first developer amount detecting means (measurement electrode member) 9. Specifically, the pointer points at the "Full" portion displayed on the graduations 53*a* when the developer amount is 500 g, and moves toward the "Empty" side displayed on the graduations 53*a* as the developer amount detected by the measurement electrode member 9 decreases.

Subsequently, after the second developer amount detecting means (electrode plate) 10 starts detecting the decrease of the developer, that is when the pointer 51 points at the portion shown by the arrow a in FIG. 5A and the developer residual amount reaches about 150 g or less, the display is switched to a second developer amount indicator 50B shown in FIG. 5B.

Figure 5B:
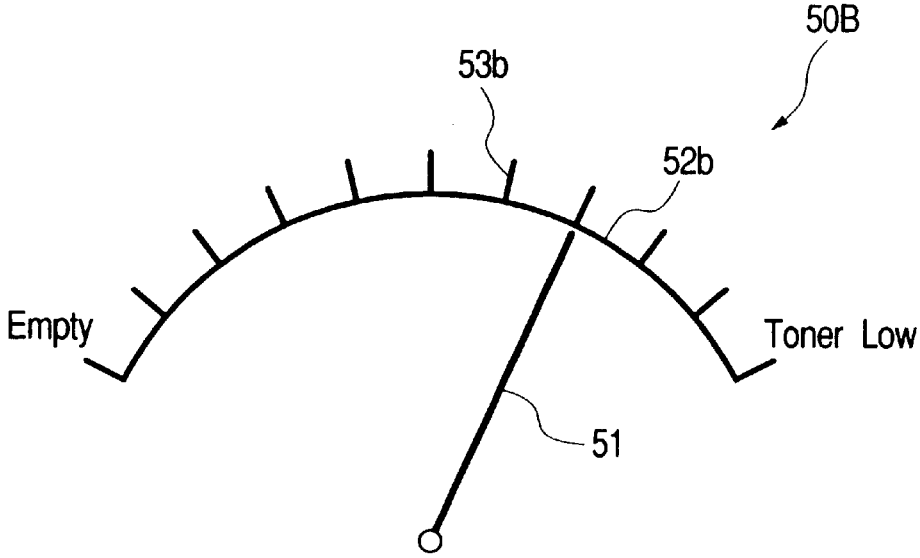

In the second developer amount indicator 50B shown in FIG. 5B, a gauge 52*b* is divided by graduations 53*b* for dividing a span indicating a small amount of developer from "Toner Low" to "Empty" into ten equal portions, and one graduation corresponds to the developer amount of about 15 g. In this manner, the second developer amount indicator 50B indicates the developer amount in more detail, that is, more finely than the first developer amount indicator 50A, so that the user can easily grasp the developer amount correctly.

After switching to the second developer amount indicator 50B, the pointer 51 moves toward the "Empty" side displayed on the graduations 53*b* in accordance with the detection result of the electrode plate 10 as the developer amount decreases. Finally the developer runs out when the pointer 51 moves to the "Empty" portion displayed on the graduations 53*b*.

As described above, by the constitution in which the developer amount indicator is switched in accordance with the detection results of a plurality of developer amount detecting means disposed in the process cartridge 100, developer-amount indication is possible in accordance with properties of the developer amount detecting means. Particularly, in the present embodiment, since the second developer amount detecting means 10 for detecting the developer amount in a small-amount-of-developer state is constituted with a higher detection precision than that of the first developer amount detecting means 9 for detecting the developer amount in a large-amount-of-developer developer state, the user can correctly be notified of the developer amount in more detail in the state in which the amount of developer is small.

Figure 6:
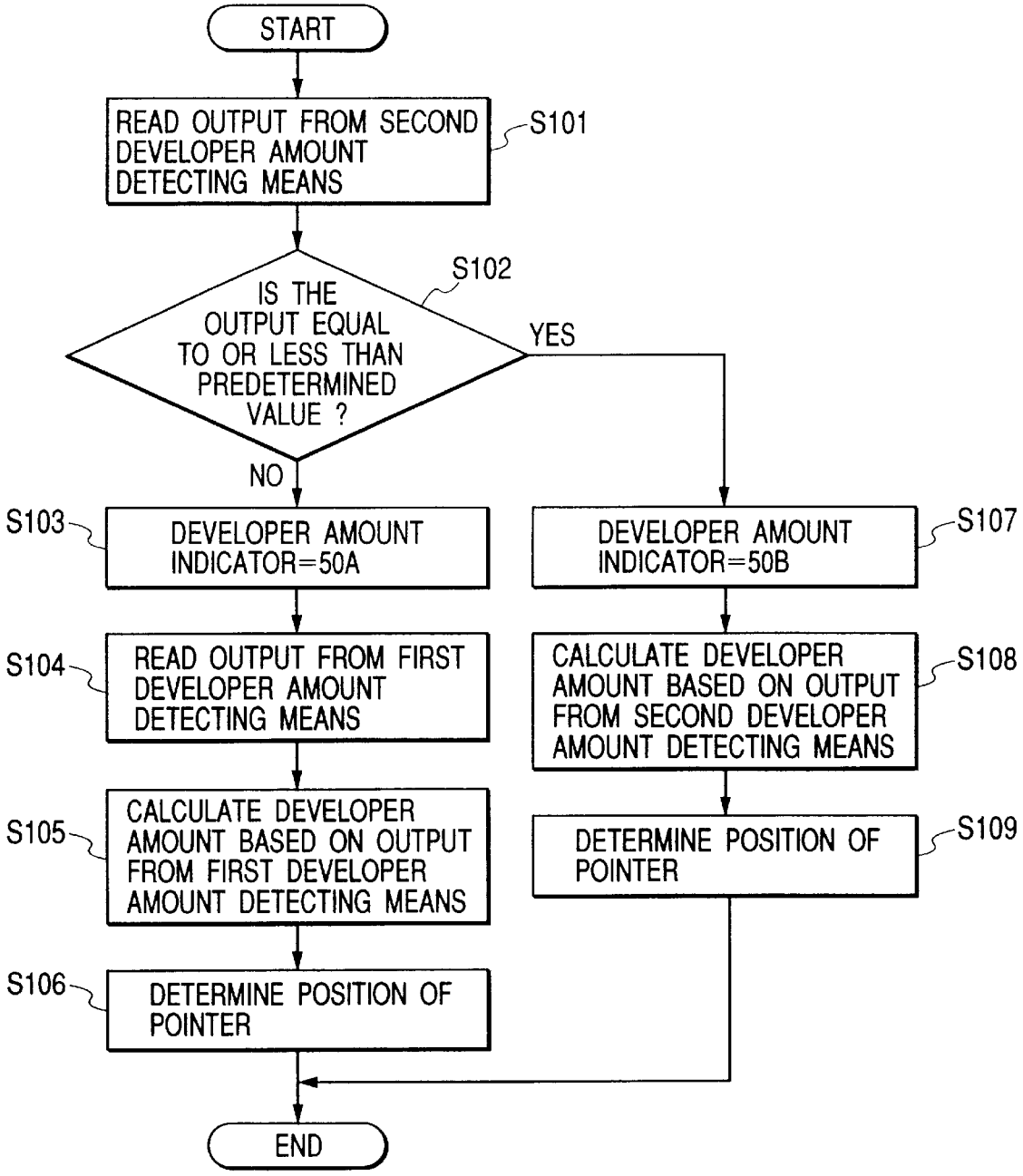
FIG. 6 is a flowchart of one embodiment of a developer amount indicating operation according to the present invention.

The aforementioned developer amount indicating operation will further be described with reference to a flowchart of FIG. 6.

First, after reading an output value from the second developer amount detecting means (electrode plate) 10 (S101), it is determined whether the value is equal to or less than a predetermined value (S102). Here, when the value is neither equal to nor less than the predetermined value, the developer amount is in a detection span of the first developer amount detecting means (measurement electrode member) 9, and the developer amount indicator to be displayed is set to the first developer amount indicator 50A (S103). Moreover, after reading an output from the measurement electrode member 9 (S104), the developer amount is calculated (S105). Subsequently, a position of the pointer 51 is determined to perform developer-amount indication (S106).

In S102, when the output of the electrode plate 10 is equal to or less than the predetermined value, the developer amount is in the detection span of the electrode plate 10, and the developer amount indicator to be displayed is set to the second developer amount indicator 50B (S107). Moreover, after calculating the developer amount from the output of the electrode plate 10 (S108), the position of the pointer 51 is determined to perform developer-amount indication (S109).

Additionally, in the developer-amount indicating method of the present embodiment, in order to easily recognize the switch of the developer amount indicator by the user, the colors of the gauges 52*a*, 52*b* shown in FIGS. 5A and 5B may be varied. Furthermore, in the gauge 52*a* shown in FIG. 5A, in order to warn the user that the developer residual amount is small, the color of the last graduation of the gauge 52*a* may be changed.

Figure 7A:
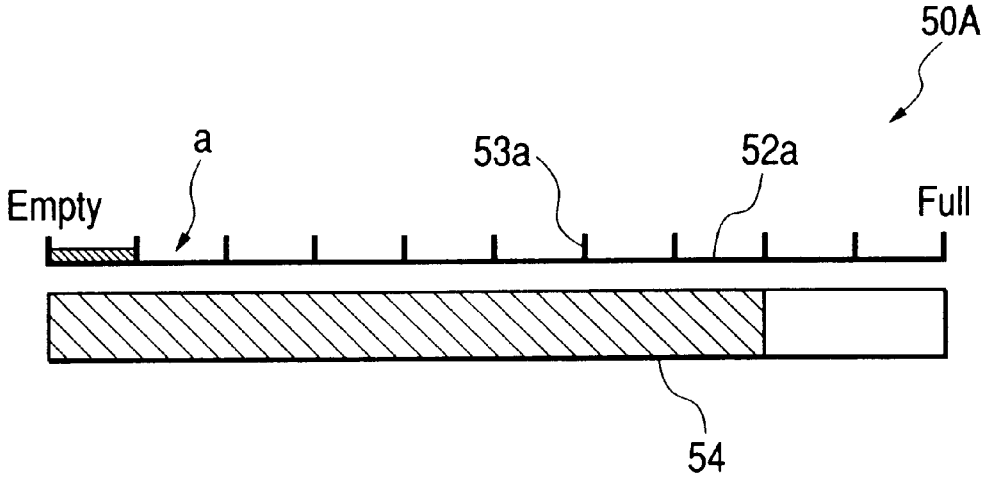
FIGS. 7A and 7B are diagrams showing a modified example of the developer amount indicating method shown in FIGS. 5A and 5B.
Figure 7B:
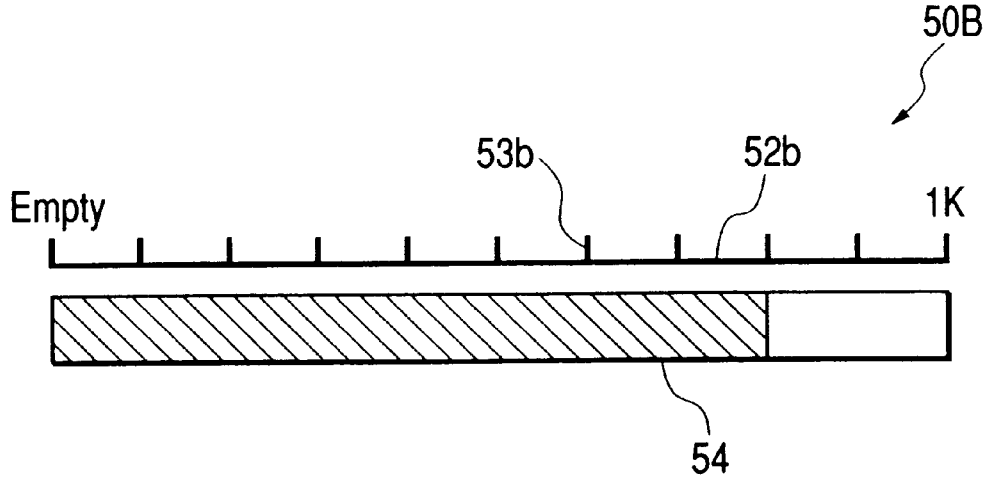

Moreover, the following developer amount indicator may also be possible. Specifically, as shown in FIGS. 7A and 7B, in a modified example of the aforementioned embodiment, in the first and second developer amount indicators 50A, 50B, instead of the pointer 51, the developer amount is indicated by a position of an end of a lightened portion of a bar 54 whose length changes in a horizontal direction in the drawings in the gauges 52*a*, 52*b*. Even in this constitution, the effect of the present invention can similarly be obtained.

Figure 8A:
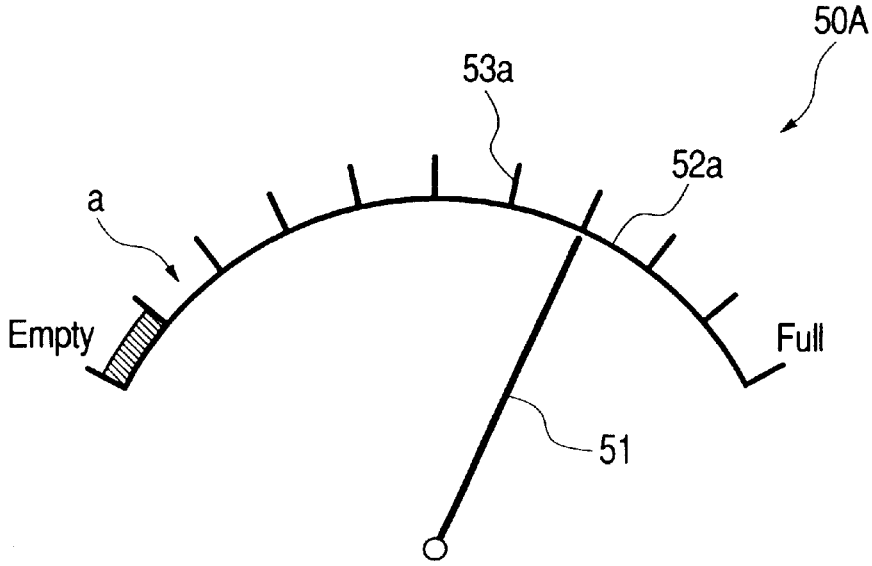
FIGS. 8A and 8B are diagrams showing another modified example of the developer amount indicating method shown in FIGS. 5A and 5B.
Figure 8B:
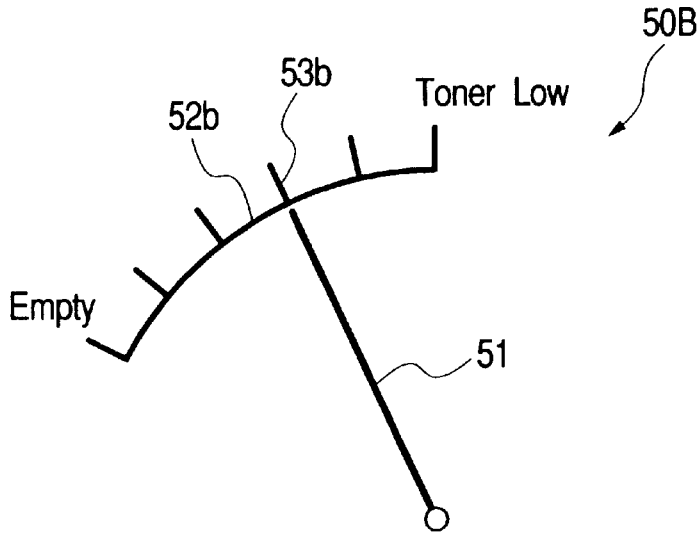
Figure 9A:
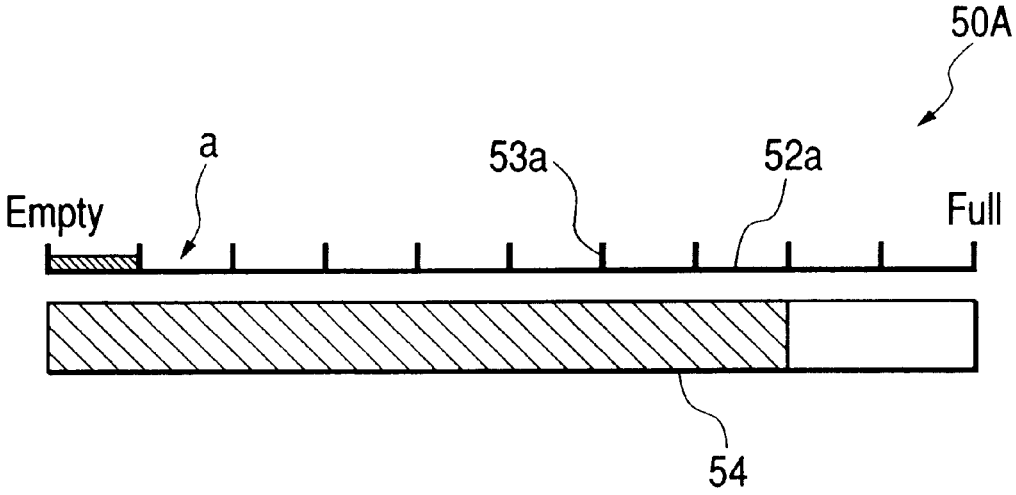
FIGS. 9A and 9B are diagrams showing still another modified example of the developer amount indicating method shown in FIGS. 5A and 5B.
Figure 9B:
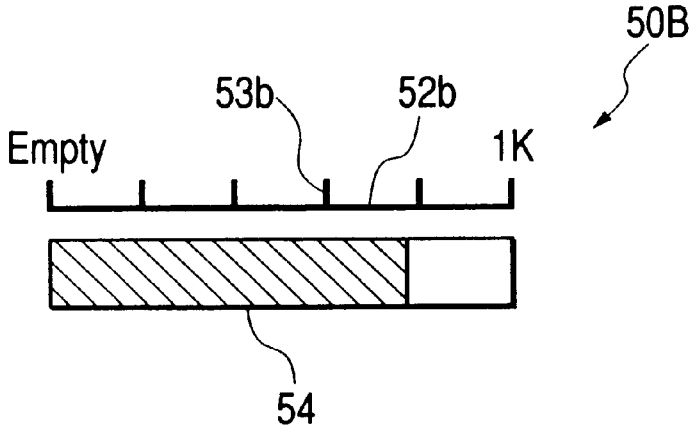

Furthermore, FIGS. 8A, 8B, 9A and 9B show other modified examples of the aforementioned embodiment. In developer amount indication examples shown in FIGS. 8A, 8B, 9A and 9B, the size of the gauge 52*b* after switching from the first developer amount indicator 50A to the second developer amount indicator 50B is allowed to differ from the size of the gauge 52*a* before the switching, so that the user can easily know that the developer residual amount is small. FIGS. 8A and 8B show an example of the indicator in which the pointer 51 is used, and FIGS. 9A and 9B show an example of the indicator in which the bar 54 is used instead of the pointer 51.

As described above, according to the present invention, the developer amount indication can be performed in such a manner that the user can easily read the amount, and particularly when the developer amount decreases, the user can be notified of the correct developer amount in more detail.

Embodiment 2

Figure 10:
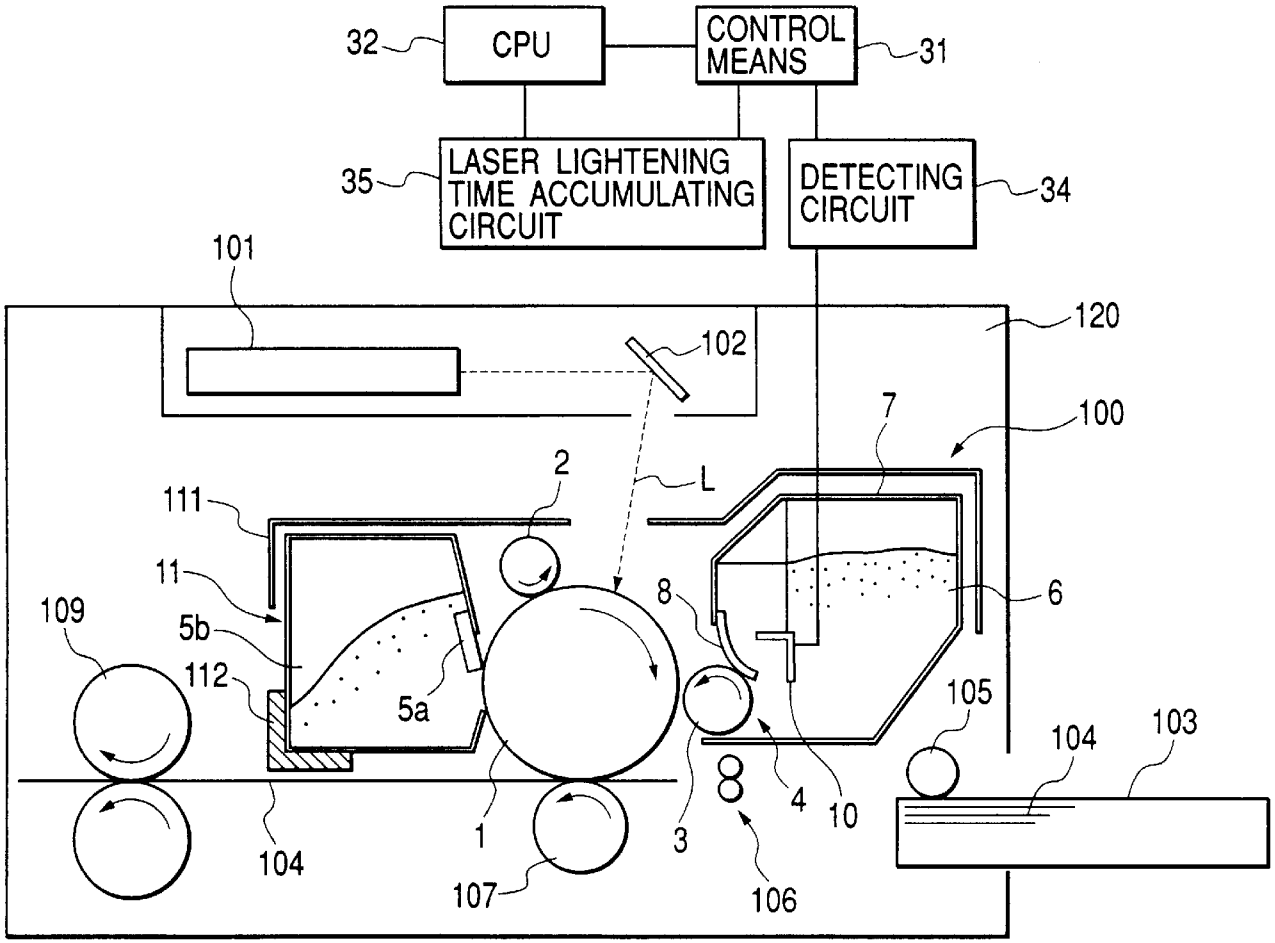
FIG. 10 is a schematic view showing another embodiment of the electrophotographic image forming apparatus according to the present invention.

Another embodiment of the present invention will be described with reference to FIG. 10.

The image forming apparatus of the present embodiment is basically similar to the image forming apparatus of the first embodiment, and is different only in the developer-amount detecting means and developer-amount indicating method. Therefore, elements provided with the same functions and constitutions as those of the image forming apparatus of the first embodiment are denoted with the same reference numerals, and a detailed description thereof is omitted.

In the present embodiment, the first developer amount detecting means for successively detecting the developer amount includes a laser lightening time accumulating circuit 35 for accumulating the lightening time of laser disposed in the scanner unit 101, which is exposure means. The laser lightening time accumulating circuit 35 is disposed in the image forming apparatus main body 120. As described later in detail, the laser lightening time accumulating circuit 35 accumulates the laser lightening time as developer-amount information, subjects the information to a predetermined processing and sends a developer amount detection signal as the electric signal to the control means 31 disposed in the image forming apparatus main body 120.

Moreover, similar to the first embodiment, the second developer amount detecting means includes the electrode plate 10 disposed along and in the vicinity of the longitudinal direction of the developing roller 3. When the process cartridge 100 is mounted on the image forming apparatus main body 120, the electrode plate 10 is electrically connected to the developer amount detecting circuit 34 disposed in the image forming apparatus main body 120. The developer amount detecting circuit 34 inputs the developer-amount information as the voltage signal obtained by the electrode plate 10, subjects the signal to the amplification processing or another predetermined signal processing, converts the signal to the developer-amount detection signal as the electric signal, and subsequently sends the signal to the control means 31 disposed in the image forming apparatus main body 120. Moreover, the control means 31 is connected to tho CPU 32 similarly disposed in the image forming apparatus main body 120.

The CPU 32 calculates the developer amount based on the signal from the control means 31. Moreover, as described later in detail, a signal for indicating the developer amount based on the detection results of the first and second developer amount detecting means 9, 10 is outputted.

In the present embodiment, the control means 31, CPU 32 and developer amount detecting circuit 34 constitute a controller for performing developer-amount indication based on the detection result of the developer-amount detecting means.

The laser lightening time accumulating circuit 35, which is the first developer amount detecting means in the present embodiment will next be described with reference to FIG. 11.

Figure 11:
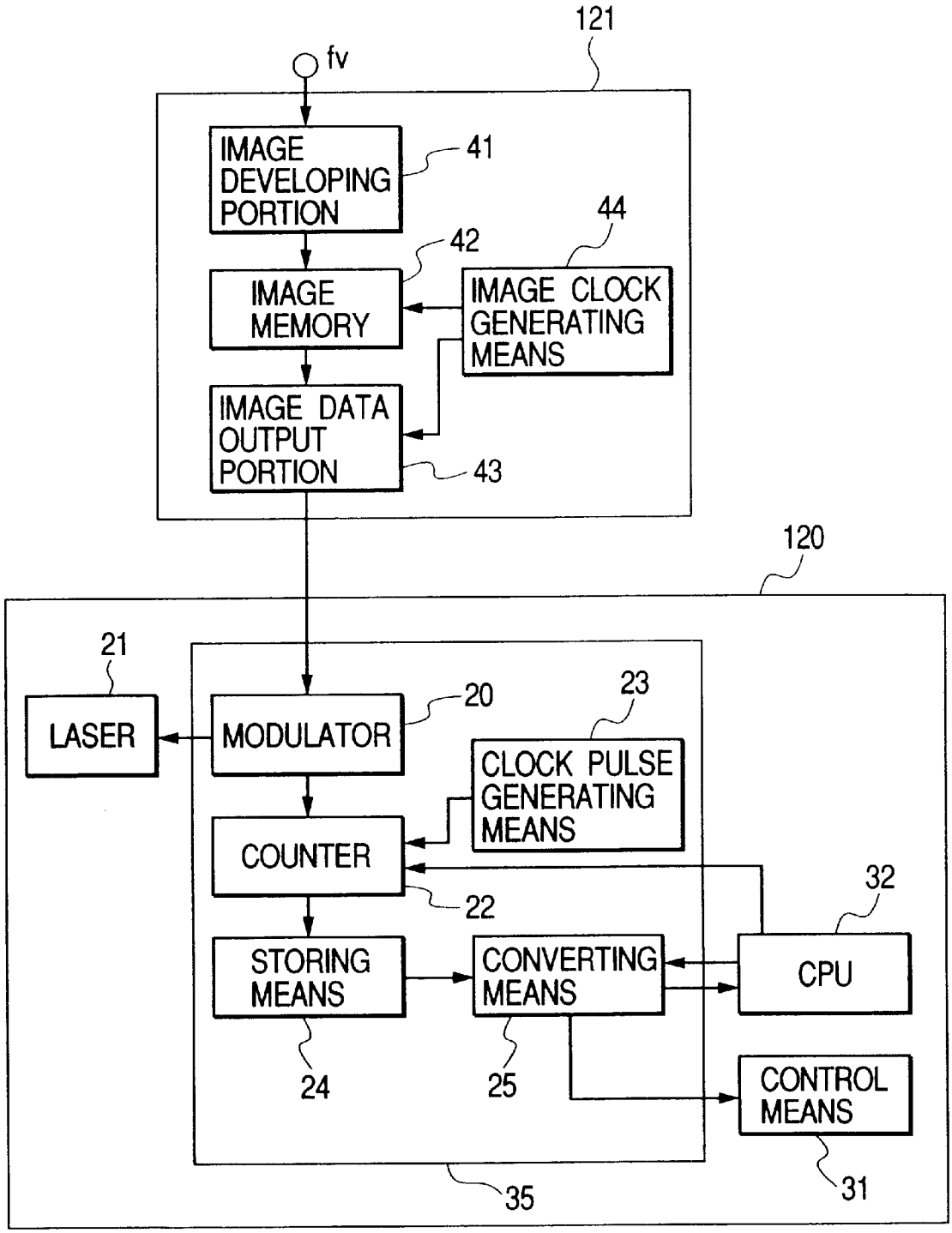
FIG. 11 is a block diagram for describing a laser lightening time accumulating circuit as the developer amount detecting means.

As shown in FIG. 11, print data fv, inputted from the host computer (not shown) connected to the image forming apparatus main body 120 in such a manner that communication is possible, is inputted to a controller (image processor) 121, and developed to provide dot data in an image developing portion 41. The developed print data is once stored in an image memory 42, and subsequently sent as a serial image signal to the image forming apparatus main body 120 by an image data output portion 43. Moreover, the controller 121 is provided with image clock generating means 44.

The image signal sent to the image forming apparatus main body 120 is modulated by a modulator 20 in accordance with the image signal fv to provide a laser input voltage which turns on/off a laser 21. Specifically, the laser 21 is connected to the modulator 20, and emits light in response to the modulated signal. Moreover, the modulator 20 is connected to a counter 22, and the counter 22 measures the output time to the laser 21 from the modulator 20, that is, the time-information-indicating-exposure time of the photosensitive drum 1 to the laser beam outputted from the laser 21.

Specifically, the counter 22 is connected to clock pulse generating means 23 such as a crystal oscillator, and a value obtained by counting the number of clock pulses received while a laser-emitting-signal lasts is used as time information. The measured clock-pulse number is added and successively written to storing means 24.

In the present embodiment, since the laser-exposure time is directly counted by the clock-pulse number, for example, a multivalued signal for lengthening a light emitting time for one dot pixel of the laser with respect to an image-high-density portion, and shortening the light emitting time for one dot pixel with respect to an image-medium-density portion can also be utilized as the image signal.

The time information written to the storing means 24 is connected to converting means 25. The converting means 25 is connected to the CPU 32, and calculates the consumed developer amount in accordance with a developer-consumption preset with respect to a unit time in the CPU 32. The calculated developer consumption is sent to the control means 31.

Figure 12:
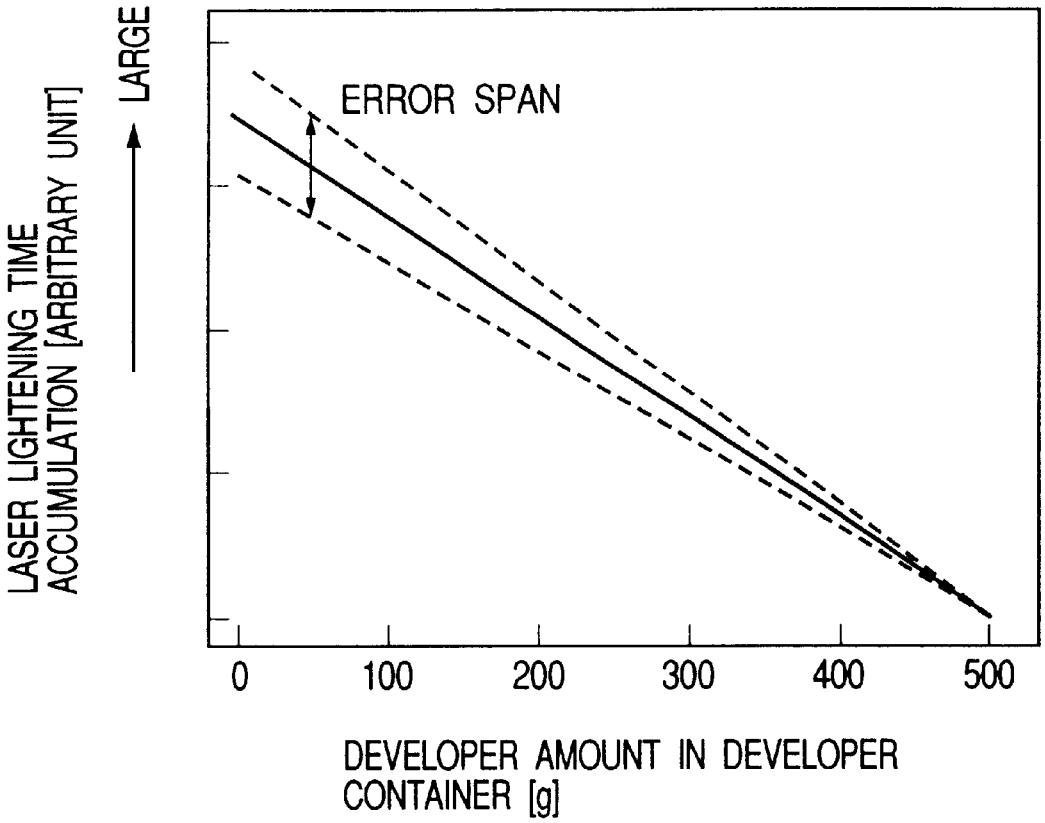
FIG. 12 is a graph showing the output characteristics of the developer amount detecting means for describing the output characteristics of the laser lightening time accumulating circuit.

FIG. 12 shows the correlation between the laser lightening time and the amount of the developer actually remaining in the developing device 7. In FIG. 12, a solid line shows the relation between a typical developer amount and laser lightening time, and the broken line shows a detection-error span by a difference in the print environment, the print pattern, or the like.

As seen from the graph shown in FIG. 12, for the developer amount detected by the laser lightening time accumulating circuit 35 as the first developer amount detecting means, when the container is nearly full of the developer, that is, in the early stages of use of the process cartridge 100, the detection error is small, but the detection error increases when the developer amount decreases. Therefore, when the developer amount is reduced, with the combined use of the developer amount detecting means, the device is able to detect the developer amount with a high precision, which is desirable.

Even when the detection of the developer amount by the laser lightening time accumulating circuit 35 provided with such properties is combined and used with the electrode plate 10 as the second developer amount detecting means provided with the properties described in the first embodiment, the developer amount indicating method of the present invention is effective. Additionally, since the output characteristics of the electrode plate 10 are similar to those of the first embodiment, a description thereof is omitted.

Figure 13:
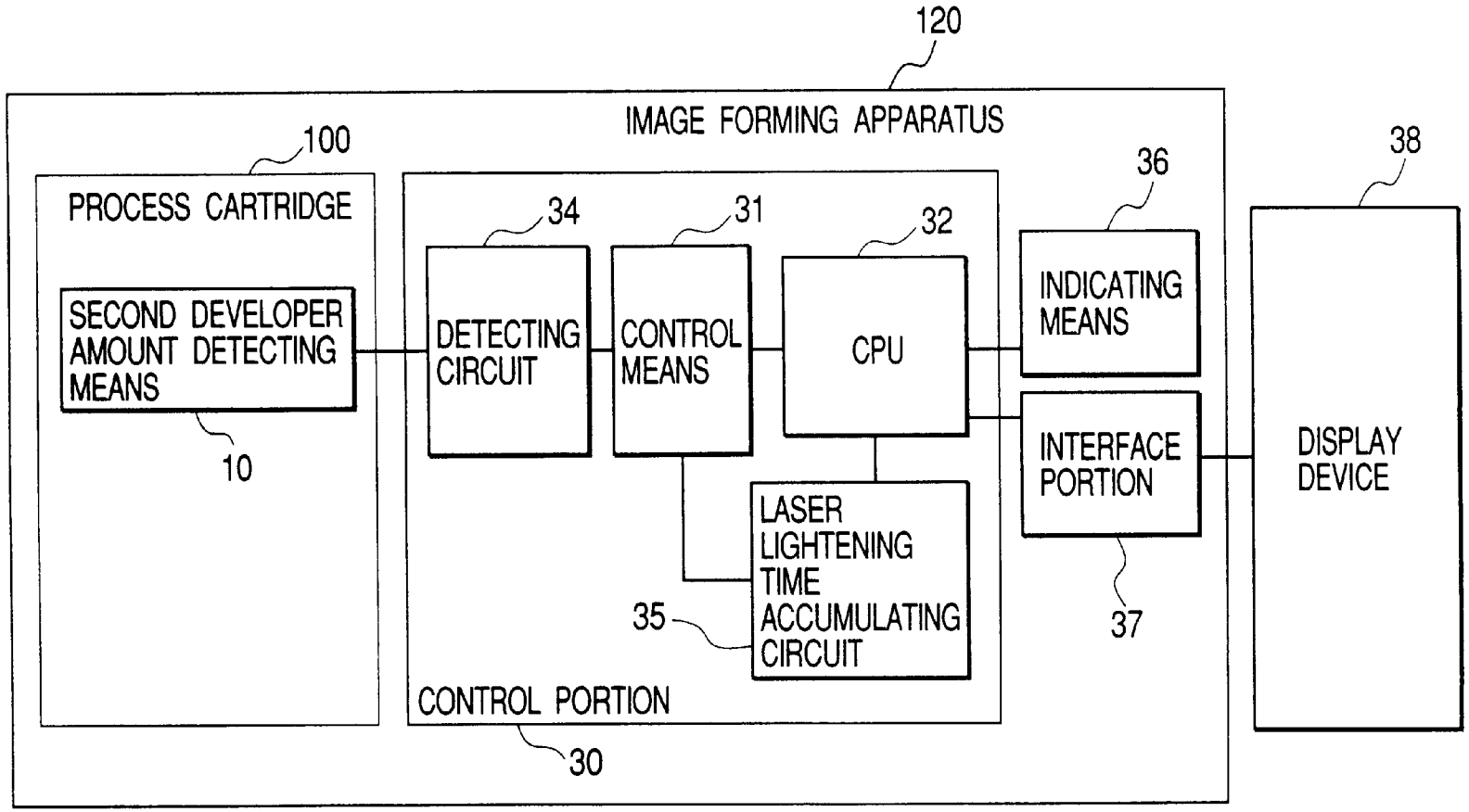
FIG. 13 is a block diagram of another embodiment of the electrophotographic image forming apparatus according to the present invention.

A developer-amount-indication control system in the present embodiment will further be described with reference to FIG. 13. Similar to the first embodiment, the signal indicating the developer amount detected by the second developer amount detecting means (electrode plate) 10 disposed in the process cartridge 100 is sent to the developer amount detecting circuit 34 disposed in the image forming apparatus main body 120, converted to the electric signal and subsequently inputted to the control means 31.

Moreover, the first developer amount detecting means (laser lightening time accumulating circuit) 35 disposed in the image forming apparatus main body 120 accumulates lightening signals from the CPU 32, and sends an accumulated value to the control means 31.

The control means 31 calculates the developer amount from the respective signals and sends the amount to the CPU 32. The CPU 32 sends the signal indicating the developer amount to the indicating means 36 constituted, for example, of the liquid crystal display disposed in the image forming apparatus main body 120.

Moreover, similar to the first embodiment, the signal of the CPU 32 is sent to the external display device 38 of the image forming apparatus main body 120 via the interface portion 37, so that the developer amount may be indicated on the external display means 38. As described above, concrete examples of the external display device 38 include the screen (the display) of the host computer connected to the image forming apparatus, and the like in the image forming apparatus connected to the personal computer network. Thereby, the developer amount can be known, for example, by operating the host computer, and convenience can remarkably be enhanced.

The developer amount indicating method of the present embodiment will next be described with reference to FIGS. 14A and 14B.

Even in the constitution of the present embodiment, similar to the first embodiment, first the developer amount is successively indicated based on the detection result of the first developer amount detecting means, and subsequently the developer amount can successively be indicated based on the detection result of the second developer amount detecting means. In this case, by the respective detectable areas, switching of the detection by the first and second developer amount detecting means is recognized, and the developer amount indicator is switched.

Figure 14A:
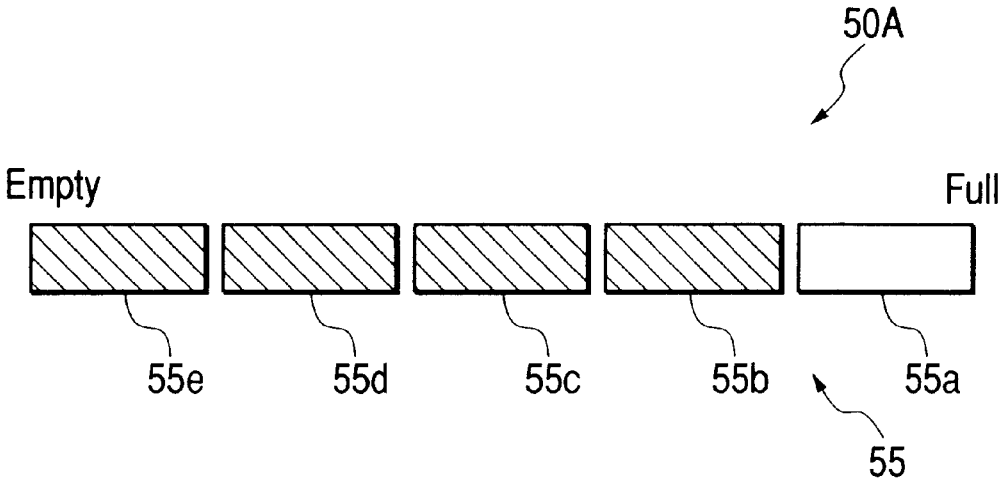
FIGS. 14A and 14B are diagrams showing another embodiment of the developer amount indicating method according to the present invention.

First, in the early stages of use of the process cartridge 100, that is, when the developer amount is large, the first developer amount indicator 50A shown in FIG. 14A is displayed. In the developer amount indicator 50A shown in FIG. 14A, a gauge 55 is constituted by segments 55*a* to 55*e* obtained by dividing the span of "Full" to "Empty" into five equal portions, and one segment corresponds to about 100 g of developer. Moreover, the respective segments 55*a* to 55*e* indicate the developer amount by combining a lightened portion with an extinguished portion in accordance with the detection result of the first developer amount detecting means (laser lightening time accumulating circuit) 35.

Specifically, when the developer amount is 500 g, all of the segments 55*a* to 55*e* are turned on, and every time it is detected that about 100 g of developer is consumed, the segments are turned off in order from the segment 55*a* on the right side of FIG. 14A. Therefore, FIG. 14A shows a state in which the developer amount is in a range of 300 g to 400 g.

Subsequently, after the detected value of the developer amount by the electrode plate 10 as the second developer amount detecting means starts decreasing, that is, when only the segment 55*e* is lightened and the developer amount is about 150 g or less, the indicator is switched to the second developer amount indicator 50B shown in FIG. 14B.

Figure 14B:
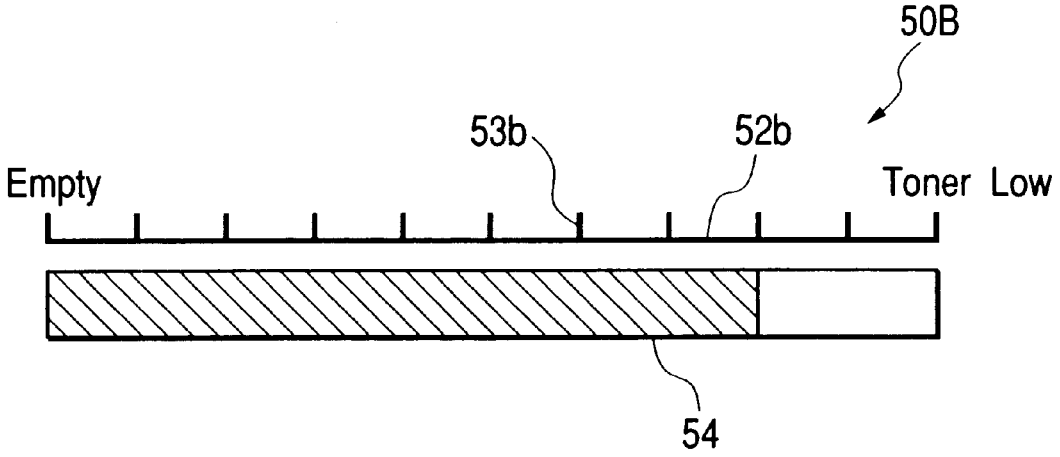

In the developer amount indicator 50B shown in FIG. 14B, the gauge 52*b* is displayed by dividing a span indicating a small amount of developer from "Toner Low" to "Empty" into ten equal portions by the graduations 53*b*, and one graduation corresponds to about 15 g of developer. In this manner, while the first developer amount indicator 50A before switching of the developer amount indicator indicates 100 g of developer by one segment, the second developer amount indicator 50B is constituted to be able to indicate the developer amount in more detail.

After switching to the second developer amount indicator 50B, the end of the lightened portion of the bar 54, whose length changes in the horizontal direction of FIG. 14B, moves toward the "Empty" side in response to the detection result by the electrode plate 10 as the second developer amount detecting means and in accordance with the developer amount, and the developer amount is indicated by the portion of the gauge 52*b* pointed to by the end of the lightened portion of the bar 54. Finally, when the end of the lightened portion of the bar 54 moves to the "Empty" portion of the graduations 53*b*, the developer runs out.

Figure 15:
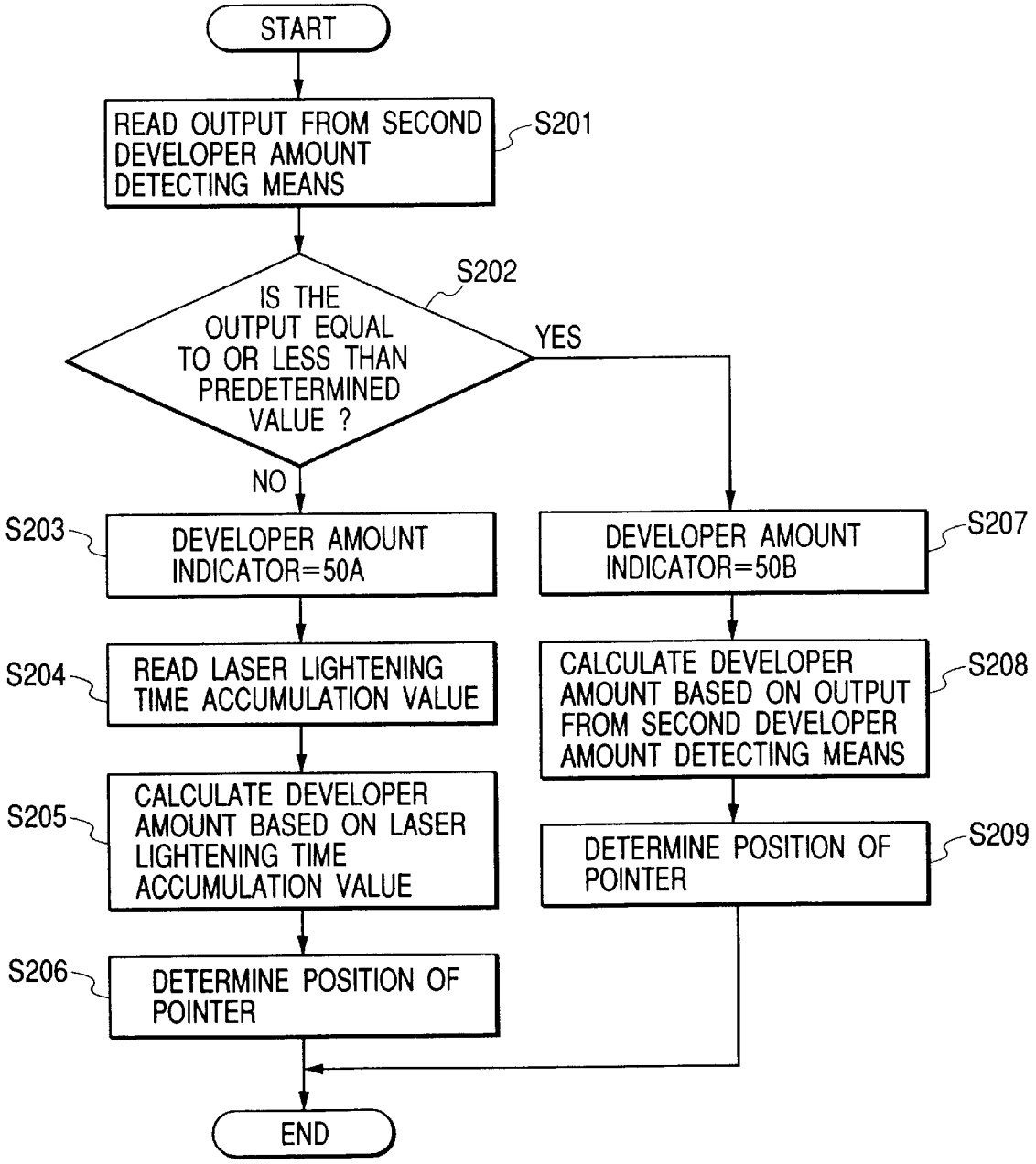
FIG. 15 is a flowchart of another embodiment of the developer amount indicating operation according to the present invention.

The aforementioned developer amount indicating operation will further be described with reference to a flowchart of FIG. 15.

First, after reading the output value from the second developer amount detecting means (electrode plate) 10 (S201), it is determined whether the value is equal to or less than the predetermined value (S202). Here, when the value is neither equal to nor less than the predetermined value, the developer amount is in an area in which a judgment is performed in accordance with the laser lightening time by the first developer amount detecting means (laser lightening time accumulating circuit) 35, and the developer amount indicator to be displayed is set to the first developer amount indicator 50A (S203). Moreover, after reading a laser lightening time accumulation value (S204), the developer amount is calculated (S205). Subsequently, the pointer position, that is, the lightened portion of the segments 55*a* to 55*e* in the present embodiment is determined to perform an indication operation (S206).

In S202, when the output of the electrode plate 10 is equal to or less than the predetermined value, the developer amount is in the detectable span by the electrode plate 10, and the developer amount indicator to be displayed is set to the second developer amount indicator 50B (S207). Moreover, after calculating the developer amount from the output of the electrode plate 10 (S208), the pointer position, that is, the lightened position of the bar 54 in the present embodiment is determined to perform an indication operation (S209).

In this manner, by the constitution in which the developer amount indicator is switched in accordance with the developer amount detecting means, developer-residual-amount indication is possible in accordance with the properties of the developer amount detecting means. Particularly, in the present embodiment, the value detected by the laser lightening time accumulating circuit 35 whose detection error increases with the decrease of the developer amount is switched to the detection result of the electrode plate 10 high in detection precision in the low developer state and indicated, so that the user can correctly be notified of the developer amount in the state in which the amount of developer is low.

As described above, in the constitution of the present embodiment, the developer amount calculated based on the detection result of the first developer amount detecting means (laser lightening time accumulating circuit) 35, and the developer amount detected based on the detection result of the second developer amount detecting means (electrode plate) 10 can be indicated by switching the developer-amount indicator.

Furthermore, in the constitution of the present embodiment, first the developer amount is successively indicated based on the detection result of the first developer amount detecting means, and subsequently the developer amount is successively indicated based on the detection results of the first and second developer amount detecting means.

Specifically, in the present embodiment, when the developer amount is large and is outside the detection area of the electrode plate 10, first the developer amount calculated based on the detection result of the laser lightening time accumulating circuit 35 is indicated. Subsequently, when the developer decreases and is brought into the detection area of the electrode plate 10, the display is switched to indicate the calculated developer amount by combining the developer amount calculated based on the detection result of the electrode plate 10 with the developer amount calculated based on the detection result of the laser lightening time accumulating circuit 35.

By combining the detection result of the laser lightening time accumulating circuit 35 with that of the electrode plate 10 to calculate and indicate the developer amount in this manner, the developer amount can be indicated in more detail.

Specifically, by performing such combination of operations, for example, even with the developer residual amount of every 5% of a detection resolution of the electrode plate 10, for example, every 1% developer residual amount can be detected by using the laser lightening time accumulating circuit 35 to detect the developer residual amount in a range of the 5% developer residual amount.

For the developer amount indicator, when the developer amount is large and is outside the detection area of the electrode plate 10, for example, the first developer amount indicator 50A shown in FIG. 14A is used to indicate the developer amount. Subsequently, when the developer decreases and is brought into the detection area of the electrode plate 10, the second developer amount indicator 50B shown in FIG. 14B is used. In this case, by combining the detection result of the laser lightening time accumulating circuit 35 with that of the electrode plate 10 to calculate the developer amount, a value between the graduations can be indicated more finely by the end of the bar 54.

Figure 16:
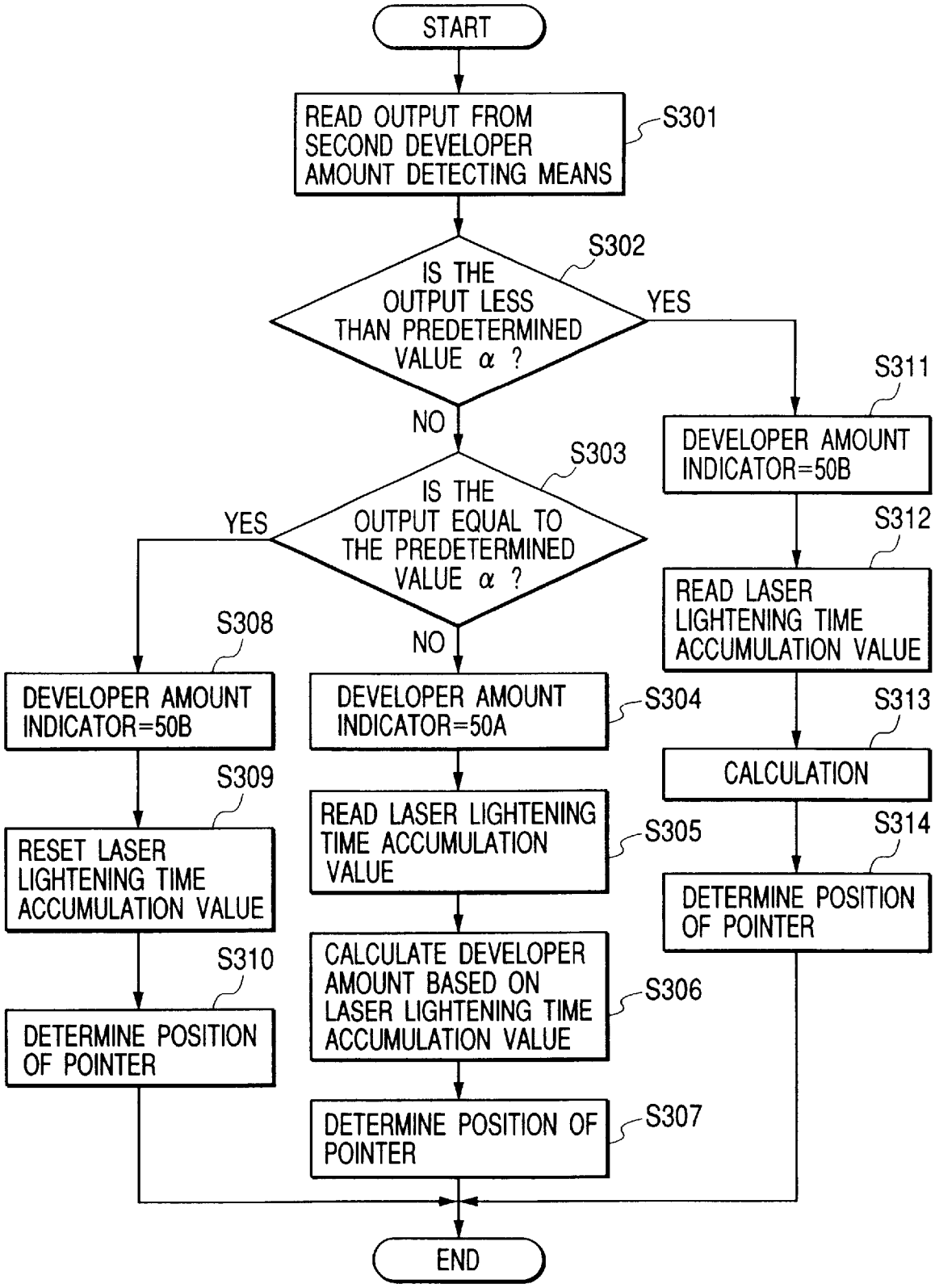
FIG. 16 is a flowchart of still another embodiment of the developer amount indicating operation according to the present invention.
Figure 17:
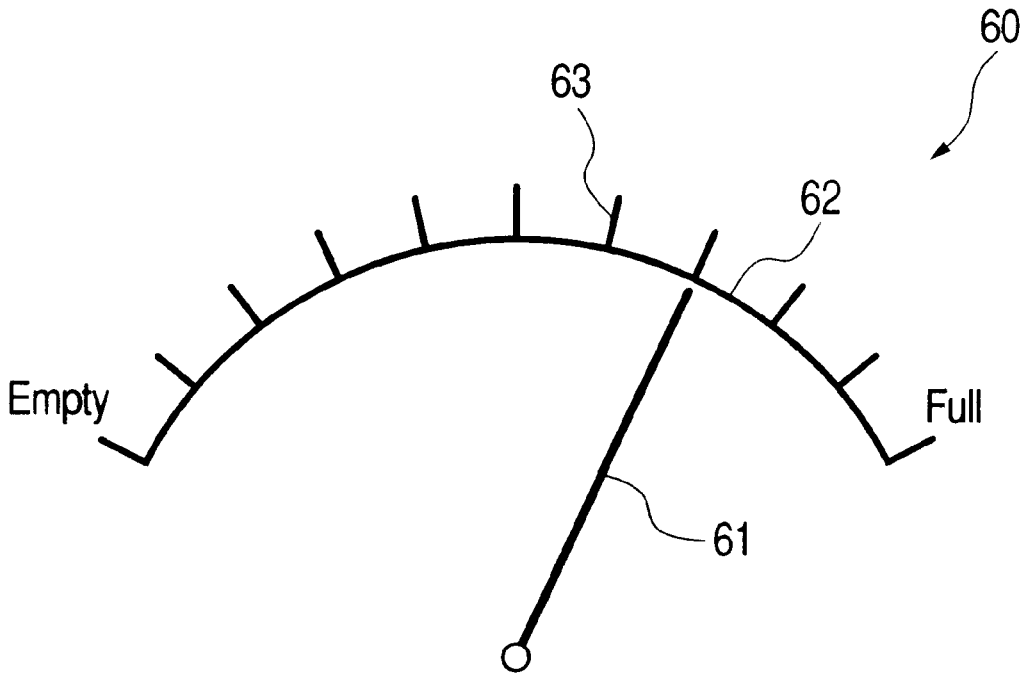
FIG. 17 is a diagram showing one example of a conventional developer amount indicating method.

The developer amount indication by the aforementioned combination will be described in more detail with reference to a flowchart of FIG. 16.

First, after reading the output value from the second developer amount detecting means (electrode plate) 10 (S301), it is determined whether the value is smaller than a predetermined value a (S302), or equal to the predetermined value a (S303). Here, the predetermined value a is a value determined after the output of the electrode plate 10 starts changing, and indicates a predetermined developer amount (e.g., residual of 25%).

When the output value of the electrode plate 10 is neither equal to nor less than the predetermined value $\alpha$, the developer amount is in the area in which judgment is performed only by the laser lightening time by the second developer amount detecting means (laser lightening time accumulating circuit) 35, and the developer amount indicator to be displayed is therefore set to the first developer amount indicator 50A (S304). Moreover, after reading the laser lightening time accumulation value (S305), the developer amount is calculated (S306). Subsequently, the lightened portion of the segments 55*a* to 55*e* is determined to perform an indication operation (S307).

In S303, when the output of the electrode plate 10 is equal to the predetermined value $\alpha$, the developer amount indicator to be displayed is set to the second developer amount indicator 50B (S308), and the laser lightening time accumulation value is reset (S309). Subsequently, the end of the lightened portion of the bar 54 is displayed in a position of the developer amount corresponding to $\alpha$ (e.g., residual of 25%) (S310). Here, the laser lightening time accumulation value is reset in order to eliminate the accumulation error up to this time, and subsequently the accumulation value after the amount reaches the predetermined value $\alpha$ is counted.

When the output of the electrode plate 10 is less than the predetermined value $\alpha$ in S302, the developer amount is in the detectable span by the electrode plate 10, and the developer amount indicator to be displayed is therefore set to the second developer amount indicator 50B (S311). Thereafter, by reading the laser lightening time accumulation value after the amount reaches $\alpha$ (S312), and calculating the output of the electrode plate 10 and the laser lightening time accumulation value, that is, calculating the developer amount between the detection resolutions of the electrode plate 10 based on the detection result of the laser lightening time accumulating circuit 35, the developer amount is calculated in more detail, the lightened position of the bar 54 is determined and the indication operation is performed (S313).

As described above, according to the constitution of the present embodiment, particularly, the user can correctly be notified of the developer amount in more detail in the state in which the amount of developer is small.

Additionally, similar to the first embodiment, the switching of the indicator can easily be recognized by allowing the developer-amount-indicator color to differ between before and after the switching, and the user can also be warned that the developer residual amount is small by changing the color of the segment 55*a* of the first developer amount indicator 50A (FIG. 14A). Moreover, even in the present embodiment, the first and second developer amount indicators 50A, 50B described in the first embodiment and shown in FIGS. 5A, 5B, 7A, 7B, 8A, 8B, 9A, 9B can naturally be used.

As described above, according to the present invention, even by the constitution of the present embodiment, developer-amount indication, comprehensible for the user can be displayed, and the user, can be notified in more detail of the correct developer amount particularly when the developer residual amount decreases.

Additionally, in the respective embodiments, the description of "Full" corresponds to an initial filling amount of the developer in the developer container 6, or an amount intended as the initial filling amount, and indicates a maximum amount detectable by the developer amount detecting means, but the indication itself is not limited to this. Therefore, for example, a numeric value indicating the developer amount, a percentage indicating a use ratio, or the like can naturally be indicated on the gauge.

Moreover, in the respective embodiments, the description of "Empty" or description that the developer runs out indicates a minimum detectable amount of the developer in the developer container 6, or indicates that the developer exists in the developer container 6 but the developer amount decreases to such an extent that image-quality level (developing quality level) has possibly deteriorated. However, the present invention does not limit the indication itself to this and, for example, the numeric value indicating the developer amount, a percentage indicating the use ratio, or the like, can naturally be indicated on the gauge. This also applies to the "Toner Lower" indicating that the amount of developer is low, and the indication itself is not limited to this.

For the developer-amount indication, it is also possible to further indicate the numeric value indicating the developer amount, the percentage indicating the use ratio, and the like.

Therefore, to indicate the developer amount in detail means that when the developer amount is indicated as the gauge, a graduation interval displayed on the gauge is narrow, that is, the developer amount indicated between the graduations is small, or that when the developer amount is indicated with numerals, the numeral interval is small.

Moreover, in the respective embodiments, first it has been described that when the amount of the developer contained in the container is set to 100% ("Full"), the developer amount is successively indicated over the whole range of 100% ("Full") to 0% ("Empty"), but the present invention is not limited to this. For example, the residual amount of the developer in the container may successively be detected over the range of 50% to 0%. Specifically, for example, even in the constitution in which the developer amount is indicated from a time when the developer in the container is half used to a time when the developer runs out, by switching the developer amount indicator in accordance with the developer amount detecting means when the developer decreases to indicate the predetermined amount, the effect of the present invention can be obtained.

According to the aforementioned embodiments, the developer amount can be indicated with good precision. Moreover, the developer-amount indication, comprehensible for the user, is possible. Furthermore, two or more developer amount detecting means are used to detect the developer residual amount in the developer container, and to notify the user of this, indication is possible in accordance with the properties of the respective developer amount detecting means, the user can be notified of the correct developer amount, and further an operator can correctly be notified of the developer residual amount in more detail when the developer amount decreases.

According to the present invention, the developer amount can be indicated with good precision.

While the invention has been described with reference to the structures disclosed herein, it is not confined to the details set forth and this application is intended to cover such modifications or changes as may come within the purposes of the improvements or the scope of the following claims.

What is claimed is:

1. A developer amount indicating method of successively indicating a developer amount in a developer containing portion mounted on an electrophotographic image forming apparatus main body, said method comprising steps of:

successively indicating said developer amount based on a detection result of first detecting means for successively detecting the developer amount in said developer containing portion; and successively indicating said developer amount in accordance with a smaller change in said developer amount as compared with an indication based on the detection result of said first detecting means, and based on a detection result of second detecting means for successively detecting the developer amount in said developer containing portion.

2. The developer amount indicating method according to claim 1, wherein said first detecting means and said second detecting means are provided with detectable areas of said developer amount, and when a detection by said first detecting means is switched to a detection by said second detecting means, a signal is received, and the indication based on the detection result of said first detecting means is switched to an indication based on the detection result of said second detecting means.

3. The developer amount indicating method according to claim 1 or 2, wherein to indicate said developer amount in accordance with the smaller change in said developer amount, when said developer amount is indicated as a gauge, a graduation interval displayed on said gauge is narrow, or when said developer amount is indicated with numerals, a numeral interval is small.

4. The developer amount indicating method according to claim 1, wherein indicating said developer amount based on the detection result of said second detecting means includes indicating said developer amount based on the detection result of said first detecting means and the detection result of said second detecting means.

5. A developer amount indicating method of successively indicating a developer amount in a developer containing portion mounted on an electrophotographic image forming apparatus main body, said method comprising steps of:

successively indicating said developer amount based on a detection result of first detecting means for successively detecting the developer amount in said developer containing portion; and successively indicating said developer amount in accordance with a smaller change in said developer amount as compared with an indication based on the detection result of said first detecting means, and based on the detection result of said first detecting means, and a detection result of second detecting means for successively detecting the developer amount in said developer containing portion.

6. The developer amount indicating method according to claim 5, wherein said second detecting means can successively detect the developer amount in a span from a time when the developer amount in said developer containing portion becomes less than an initial filling amount by a predetermined amount to a time when the developer runs out, and when a detecting operation by said second detecting means starts, a signal is received, and the indication based on the detection result of said first detecting means is switched to an indication based on the detection result of said first detecting means and the detection result of said second detecting means.

7. The developer amount indicating method according to claim 5 or 6, wherein to indicate said developer amount in accordance with the smaller change in said developer amount, when said developer amount is indicated as a gauge, a graduation interval displayed on said gauge is narrow, or when said developer amount is indicated with numerals, a numeral interval is small.

8. The developer amount indicating method according to claim 1 or 5, wherein said first detecting means and said second detecting means use information in accordance with a capacitance between conductors generated during application of a voltage between said conductors to detect said developer amount, or said first detecting means uses information in accordance with a laser exposure time to detect said developer amount.

9. The developer amount indicating method according to claim 1 or 5, wherein said indication comprises a step of performing display on a display screen of said apparatus main body or a computer.

10. An electrophotographic image forming apparatus for forming an image on a recording medium, comprising:

an electrophotographic photosensitive member;

developing means for developing an electrostatic latent image formed on said electrophotographic photosensitive member;

a developer containing portion for containing a developer for use in developing said electrostatic latent image by said developing means;

first detecting means for successively detecting a developer amount in said developer containing portion;

second detecting means for successively detecting the developer amount in said developer containing portion; and indicating means for successively indicating said developer amount based on a detection result of said first detecting means, and successively indicating said developer amount in accordance with a smaller change in said developer amount as compared with an indication based on the detection result of said first detecting means, and based on a detection result of said second detecting means.

11. The electrophotographic image forming apparatus according to claim 10, wherein said first detecting means and said second detecting means are provided with detectable areas of said developer amount, and when a detection by said first detecting means is switched to a detection by said second detecting means, a signal is received, and the indication based on the detection result of said first detecting means is switched to an indication based on the detection result of said second detecting means.

12. The electrophotographic image forming apparatus according to claim 10 or 11, wherein to indicate said developer amount in accordance with the smaller change in said developer amount, when said developer amount is indicated as a gauge, a graduation interval displayed on said gauge is narrow, or when said developer amount is indicated with numerals, a numeral interval is small.

13. The electrophotographic image forming apparatus according to claim 10, wherein indicating said developer amount based on the detection result of said second detecting means includes indicating said developer amount based on the detection result of said first detecting means and the detection result of said second detecting means.

14. An electrophotographic image forming apparatus for forming an image on a recording medium, comprising:

an electrophotographic photosensitive member;

developing means for developing an electrostatic latent image formed on said electrophotographic photosensitive member;

a developer containing portion for containing a developer for use in developing said electrostatic latent image by said developing means;

first detecting means for successively detecting a developer amount in said developer containing portion;

second detecting means for successively detecting the developer amount in said developer containing portion; and indicating means for successively indicating said developer amount based on a detection result of said first detecting means, and successively indicating said developer amount in accordance with a smaller change in said developer amount as compared with an indication based on the detection result of said first detecting means, and based on the detection result of said first detecting means and a detection result of said second detecting means.

15. The electrophotographic image forming apparatus according to claim 14, wherein said second detecting means can successively detect the developer amount in a span from a time when the developer amount in said developer containing portion becomes less than an initial filling amount by a predetermined amount to a time when the developer runs out, and when a detecting operation by said second detecting means starts, a signal is received, and the indication based on the detection result of said first detecting means is switched to an indication based on the detection result of said first detecting means and the detection result of said second detecting means.

16. The electrophotographic image forming apparatus according to claim 14 or 15, wherein to indicate said developer amount in accordance with the smaller change in said developer amount, when said developer amount is indicated as a gauge, a graduation interval displayed on said gauge is narrow, or when said developer amount is indicated with numerals, a numeral interval is small.

17. The electrophotographic image forming apparatus according to claim 10 or 14, wherein said first detecting means and said second detecting means use information in accordance with a capacitance between conductors generated during application of a voltage between said conductors to detect said developer amount, or said first detecting means uses information in accordance with a laser exposure time to detect said developer amount.

18. The electrophotographic image forming apparatus according to claim 10 or 14, wherein the electrophotographic photosensitive member and said developing means are integrally formed as a unit, and are detachably mountable as a process cartridge on an apparatus main body of said electrophotographic image forming apparatus.

* * * * *

UNITED STATES PATENT AND TRADEMARK OFFICE

CERTIFICATE OF CORRECTION

PATENT NO. : 6,516,159 B1
DATED : February 4, 2003
INVENTOR(S) : Kasushige Sakurai It is certified that error appears in the above-identified patent and that said Letters Patent is hereby corrected as shown below:

Column 8,
Line 29, "developer-" should read -- developer --.

Column 15,
Line 34, "a" should read -- α --.
Line 35, "a" (1st and 2nd occurrences) should read -- α --.

Signed and Sealed this

Eighteenth Day of November, 2003

JAMES E. ROGAN
*Director of the United States Patent and Trademark Office*